US012276175B1

(12) United States Patent
Rejepov

(10) Patent No.: US 12,276,175 B1
(45) Date of Patent: Apr. 15, 2025

(54) FLOAT SHOE WITH ANTI-COLLAPSE FEATURE FOR STRING CEMENTATION

(71) Applicant: SAUDI ARABIAN OIL COMPANY, Dhahran (SA)

(72) Inventor: Dautmammet Rejepov, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/496,775

(22) Filed: Oct. 27, 2023

(51) Int. Cl.

| | |
|---|---|
| ***E21B 33/13*** | (2006.01) |
| ***E21B 33/05*** | (2006.01) |
| ***E21B 33/14*** | (2006.01) |
| ***E21B 34/06*** | (2006.01) |

(52) U.S. Cl.
CPC ..... *E21B 33/13* (2013.01); *E21B 33/14* (2013.01); *E21B 34/06* (2013.01); *E21B 34/063* (2013.01); *E21B 33/05* (2013.01)

(58) Field of Classification Search
CPC ..... E21B 34/063; E21B 34/06; E21B 33/13; E21B 33/14; E21B 33/3305; E21B 34/025; E21B 47/06; E21B 2200/02
See application file for complete search history.

(56) References Cited

U.S. PATENT DOCUMENTS

| | | | | |
|---|---|---|---|---|
| 2,737,195 | A * | 3/1956 | Baker | E21B 34/063 166/325 |
| 3,119,451 | A | 1/1964 | Hall | |
| 3,159,219 | A * | 12/1964 | Scott | E21B 33/16 166/156 |
| 4,856,592 | A | 8/1989 | Van Bilderbeek et al. | |
| 2010/0051276 | A1 | 3/2010 | Rogers et al. | |
| 2020/0263533 | A1 * | 8/2020 | Bruce | E21B 47/117 |

* cited by examiner

*Primary Examiner* — Brad Harcourt
(74) *Attorney, Agent, or Firm* — Osha Bergman Watanabe & Burton LLP

(57) ABSTRACT

A system performs inner string cement operations in a wellbore. The system includes a stab-in stinger connected to a distal end of a drill string and a stab-in float shoe connected to a distal end of a casing. The stab-in float shoe includes a first check valve and a plug type rupture disc. The first check valve includes instructions configured to prevent a reverse flow of cement mixture. The plug type rupture disc is house between the first check valve and an outlet of the stab-in float shoe. The plug type rupture disc includes instructions configured to rupture at a predetermined threshold pressure and, once ruptured, permits flow of cement mixture from the annulus into the stab-in float shoe. A related method includes: enabling a stab-in stinger to stab-into a stab-in float shoe, starting the cementing operation and rupturing the plug-pe rupture discs at predetermined pressure.

15 Claims, 9 Drawing Sheets

FLOAT SHOE WITH ANTI-COLLAPSE FEATURE FOR STRING CEMENTATION

BACKGROUND

In the petroleum industry, wells are drilled into the surface of the Earth to access and produce hydrocarbons. The process of building a well is often split into two parts: drilling and completion. Drilling a well may include using a drilling rig to drill a hole into the ground, trip in at least one string of casing, and cement the casing string in place. The casing string is used to define the structure of the well, provide support for the wellbore walls, and prevent unwanted fluid from being produced. The casing string is cemented in place to prevent formation fluids from exiting the formation and provide further structure for the well.

After a casing string has been placed in the well, the annulus located between the casing string and the wellbore wall is often cemented completely (i.e., all the way to the surface) or partially. The cementing process involves pumping a cement mixture from the surface, through the inside of the drill string, and up the outside of the drill string and into the noted annulus, until the cement mixture reaches a predetermined height. Often, provision of the cement mixture is followed by that of another type of fluid and/or a wiper plug to push the remainder of the cement mixture out of the interior of the drill string and into the annulus. The cement mixture is left to harden before the next section of the well is drilled or the well is completed. The primary hazard of inner string cementation is the risk of casing collapse during job execution due to sudden annulus bridging.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in one or more embodiments, systems and methods for inner string cementation in a wellbore while having an anti-collapse feature. In one or more embodiments, the system includes a stab-in float shoe attached to a distal end of the casing and a stab-in stinger attached to distal end of a drill string. The stab-in float shoe houses a plug-type rupture disc connected to a check valve. The plug-type rupture disc ruptures in response to an increase of the pressure in the annulus to a predetermined threshold pressure and halts the flow of the cement mixture avoiding additional pressure buildup in the annulus. The predetermined threshold pressure is lower than the rated collapse pressure rating of the casing.

This disclosure presents, in accordance with one or more embodiments, a system that performs inner string cement operations in a wellbore. The system includes a stab-in stinger connected to a distal end of a drill string and a stab-in float shoe connected to a distal end of a casing. The stab-in float shoe includes a first check valve and a plug type rupture disc. The first check valve includes instructions configured to prevent a reverse flow of cement mixture. The plug type rupture disc is house between the first check valve and an outlet of the stab-in float shoe. The plug type rupture disc includes instructions configured to rupture at a predetermined threshold pressure and, once ruptured, permits flow of cement mixture from the annulus into the stab-in float shoe.

This disclosure presents, in accordance with one or more embodiments, a system that performs inner string cement operations in a wellbore. The system includes a stab-in stinger connected to a distal end of a drill string and a stab-in float shoe connected to a distal end of a casing. The stab-in float shoe includes a first check valve, a pressure sensor and a plug type rupture disc. The pressure sensor is mounted on a nose of the stab-in float shoe and includes instructions configured to measure the pressure in the annulus. The pressure may communicate, via a network, with a computer, a controller, a pump on cementing unit and an alarm system. The first check valve includes instructions configured to prevent a reverse flow of cement mixture. The plug type rupture disc is house between the first check valve and an outlet of the stab-in float shoe. The plug type rupture disc includes instructions configured to rupture at a predetermined threshold pressure and, once ruptured, permits flow of cement mixture from the annulus into the stab-in float shoe.

This disclosure presents, in accordance with one or more embodiments, a method for performing a cementing operation in a wellbore. In one or more embodiments, the method includes attaching a stab-in float shoe to a casing and running the casing in a wellbore. The method further includes attaching a stab-in stinger to a drill string and running the drill string into the casing. The method further includes enabling the stab-in stinger to stab into the stab-in float shoe. The method further comprises starting the cementing operation by pumping a cement mixture in the drill string via a pump on a cementing unit. The cement mixture is then pumped into the annulus through the stab-in float shoe. The stab-in float shoe comprises a plug-type rupture disc. The method further includes rupturing the plug type rupture disc at a predetermined threshold pressure in the annulus. The method further comprises stopping the cementing operation once the plug type rupture disc ruptures. Stopping the cementing operation comprises shutting down the pump of a cementing unit.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
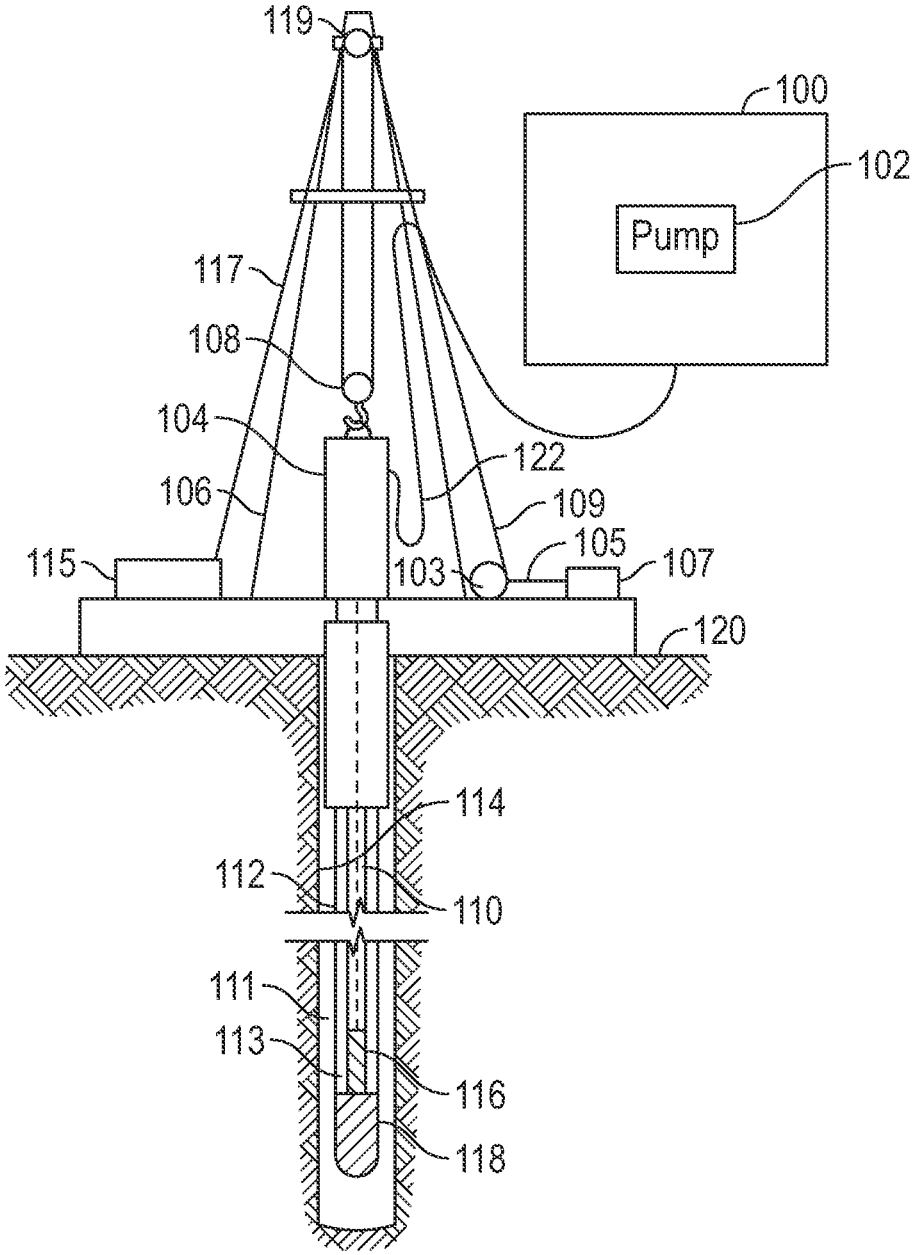
FIG. 1 schematically illustrates, in cross-sectional elevational view, an inner string cementation system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

By way of general background in accordance with one or more embodiments, after a wellbore section has been drilled at a well site, a casing may be run into the wellbore with a stab-in float shoe attached to a distal end of the casing. Then, a drill string is run into the casing with a stab-in stinger attached to the distal end of the drill string, to a planned target depth. This target depth, for example, may be about 3 feet above the stab-in float shoe, and a drilling fluid (also known as "mud" or "drilling mud") may be circulated in an annulus defined between the casing and the drill string. Circulation of the drilling fluid is stopped and the drill string then is lowered further, permitting the stab-in stinger to stab into the stab-in float shoe.

Thereafter, in accordance with one or more embodiments, cementation of the wellbore starts once a connection between the stab-in stinger and the stab-in float shoe is made. However, there are multiple scenarios that could well inhibit or prevent the full execution or completion of a cementing operation. Such scenarios include interrupted circulation of the cement mixture, or collapse of the casing due to an excessive pressure differential between an annulus and the casing-drill string annulus. For the purposes of further discussion, the "annulus" may be understood as being located in an annular volume between an external surface of the casing and an internal surface of the wellbore, and may alternatively be referred to as a "casing-wellbore annulus". The "casing-drill string annulus", for its part, may be understood as being located in the annular space between an internal surface of the casing and an external surface of the drill string.

Additionally, by way of general background in accordance with one or more embodiments, when bridge-off (i.e., bridging) in the wellbore-casing annulus occurs due to accumulation of material, such as scale or sand, the flow of cement mixture is obstructed and the pressure in the annulus increases. In this scenario, to avoid casing collapse, the cementing operation must be halted and the bridging resolved before resuming the cementing operations.

As such, FIG. 1 schematically illustrates, in cross-sectional elevational view, an inner string cementation system in accordance with one or more embodiments. The inner string cementing system depicted in FIG. 1 is provided at a well that site includes a wellbore (114) drilled into a terrestrial surface (120). A cementing head (104) may be suspended in a derrick (106) by a travelling block (108). A pump (102) of a cementing unit (100) may be coupled to the cementing head (104) via a high-pressure line (122). The cementing head (104) may be coupled to a drill string (110), for example, via threading. A stab-in float shoe (118) is coupled to a casing (112) has been run in hole prior to a cementing operation in the wellbore (114). A stab-in stinger (116) coupled to the drill string (110) has been run in the casing (112) and stabbed into the stab-in float shoe (118) prior to the cementing operation in the wellbore (114).

In accordance with one or more embodiments, a casing (112) is a tubular formed from a material, such as steel, that can withstand downhole temperatures and pressures. A casing-wellbore annulus (111) is defined between the outer surface of the casing (112) and the inner surface of the wellbore (114). The drill string (110), for its part, is a tubular is also made of a material, such as steel, that can withstand downhole temperatures and pressures. A casing-drill string annulus (113) is thus defined between the outer surface of the drill string (110) and the inner surface of the casing (112).

In accordance with one or more embodiments, FIG. 1 further depicts a weight indicator (107) connected to an anchor and load cell (103) via a high-pressure hydraulic hose (105). The anchor and load cell (103) is connected to a crown block (119) via a dead line (109). The crown block (119) is connected to a draw works (115) with a live line (117). The weight indicator (107) may measure the weight of the drill string (110) inside the casing (112).

Figure 2:
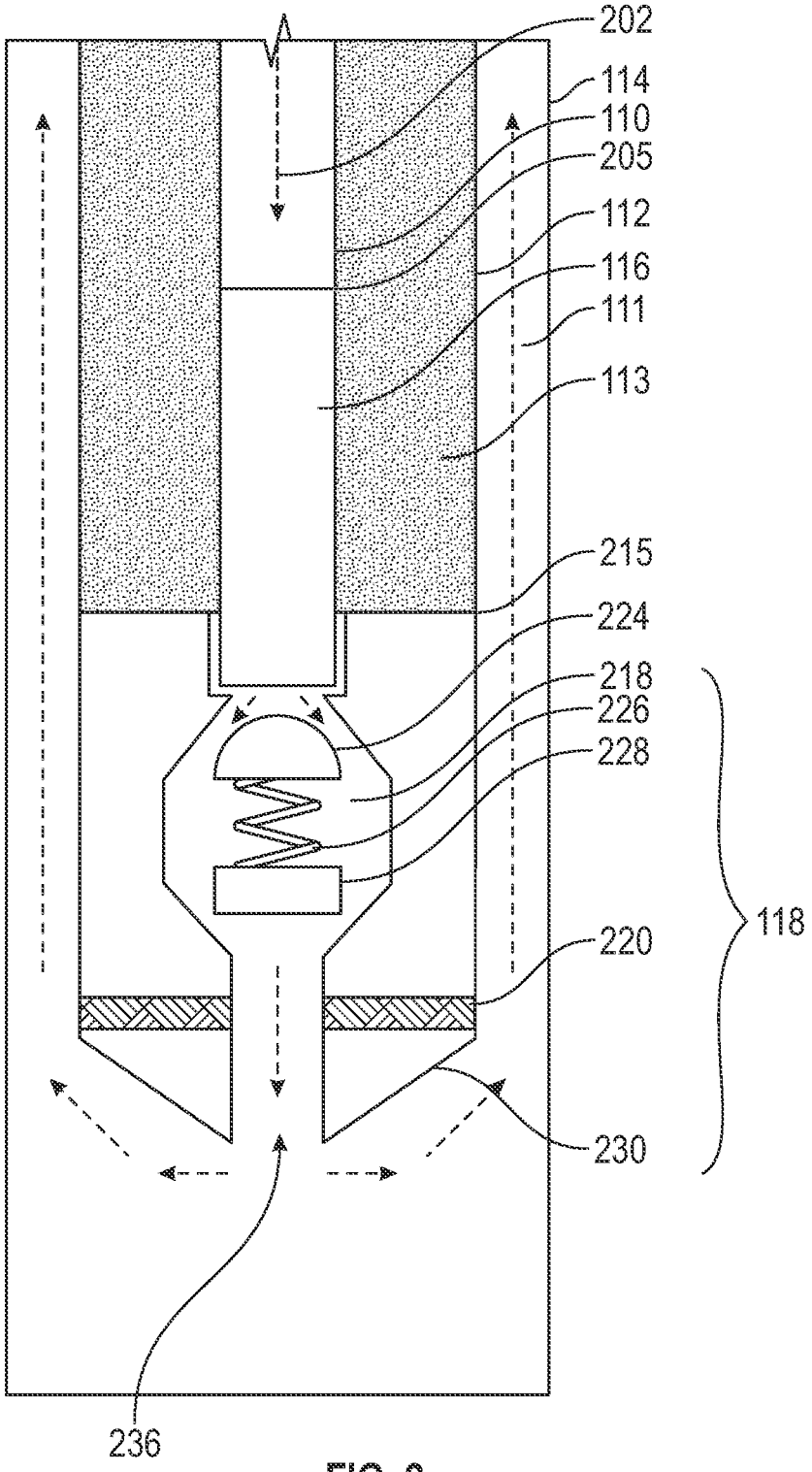
FIG. 2 schematically illustrates a closeup, cross-sectional elevational view of the drill string of FIG. 1 coupled to a stab-in stinger.

In accordance with one or more embodiments, FIG. 2 schematically illustrates a close-up, cross-sectional elevational view of the drill string (110) of FIG. 1 coupled to the stab-in stinger (116) and stabbed into the stab-in float shoe (118). The stab-in stinger (116) is connected to a distal end of a drill string (205). The stab-in float shoe (118) is connected to a distal end of a casing (215). The stab-in float shoe (118) includes a first check valve (218) and two plug-type rupture discs (220) on the inside of the stab-in float shoe (118). The plug-type rupture discs are housed in the stab-in float shoe (118), between the first check valve (218) and an outlet (236). The first check valve (218) is an integral check valve that permits fluid to flow only in one direction within the stab-in float shoe (118), i.e., in a downhole direction from the terrestrial surface (120) (see FIG. 1) toward the casing-wellbore annulus (111). Thus, the first check valve (218) prevents reverse flow of fluid back into the drill string (110). The first check valve (218) has a valve member (224) connected to a valve seat (228) via a spring (226).

In accordance with one or more embodiments, the plug-type rupture discs (220) are configured to rupture at a predetermined threshold pressure. The predetermined threshold pressure may be greater than an expected normal circulating pressure of a cement mixture (202) in a casing (112) and below the collapse pressure rating of the casing (112). The predetermined threshold pressure is adjustable, and may be set according to the collapse pressure rating of the casing (112). When the plug-type rupture discs (220) rupture, the cement mixture (202) flows into the stab-in float shoe (118) resulting in a casing-wellbore (111) pressure build-up relief.

In accordance with one or more embodiments, the stab-in stinger (116) may be made of one or more corrosion-resistant materials, such as stainless steel, or high-strength material, such as carbon steel. The external portion of the stab-in float shoe (118) may be made of the same material as the casing (112). However, internal components of the stab-in float shoe (118) may be made of cement mixture or thermoplastic, to facilitate their drilling out in the event that the wellbore (114) is to be extended or deepened.

In accordance with one or more embodiments, once the stab-in stinger (116) is stabbed into the stab-in float shoe (118), the cement operation starts by pumping the cement mixture (202) into the drill string (110) via pump (102), through the stab-in stinger (116) and into the stab-in float shoe (118). The cement mixture (202) reaches the first check valve (218) and exerts pressure on the valve member (224) to compress the spring (226) and open a passage for the cement mixture (202). As the plug-type rupture discs (220) are not yet ruptured, the cement mixture (202) is permitted to progress toward the casing-wellbore annulus (111).

In accordance with one or more embodiments, as will be further appreciated below, the stab-in float shoe (118) with a plug-type rupture disc (220) allows for inner string cementation without the risk of casing (112) collapsing due to a sudden casing-wellbore annulus (111) bridging.

As such, and as will be further appreciated here below, embodiments as broadly contemplated herein provide for systems for performing cementing operations that may be put in place to allow inner string cementation while reducing the risks of casing (112) collapsing, via holding the pressure within the casing-drill string annulus (113) to a level that is lower than the pressure collapse rating of the casing (112).

Accordingly, FIGS. 3-7 each provide a similar view as FIG. 2 but show variant arrangements and progressive stages of performing a cementing operation in wellbore (114), in accordance with one or more embodiments. For general purposes of readability, components shown in FIGS. 3-7 that are the same or similar to components shown in FIGS. 1-2 can be understood as having essentially the same description and function as set forth above, beyond any additional description provided below.

Figure 3:
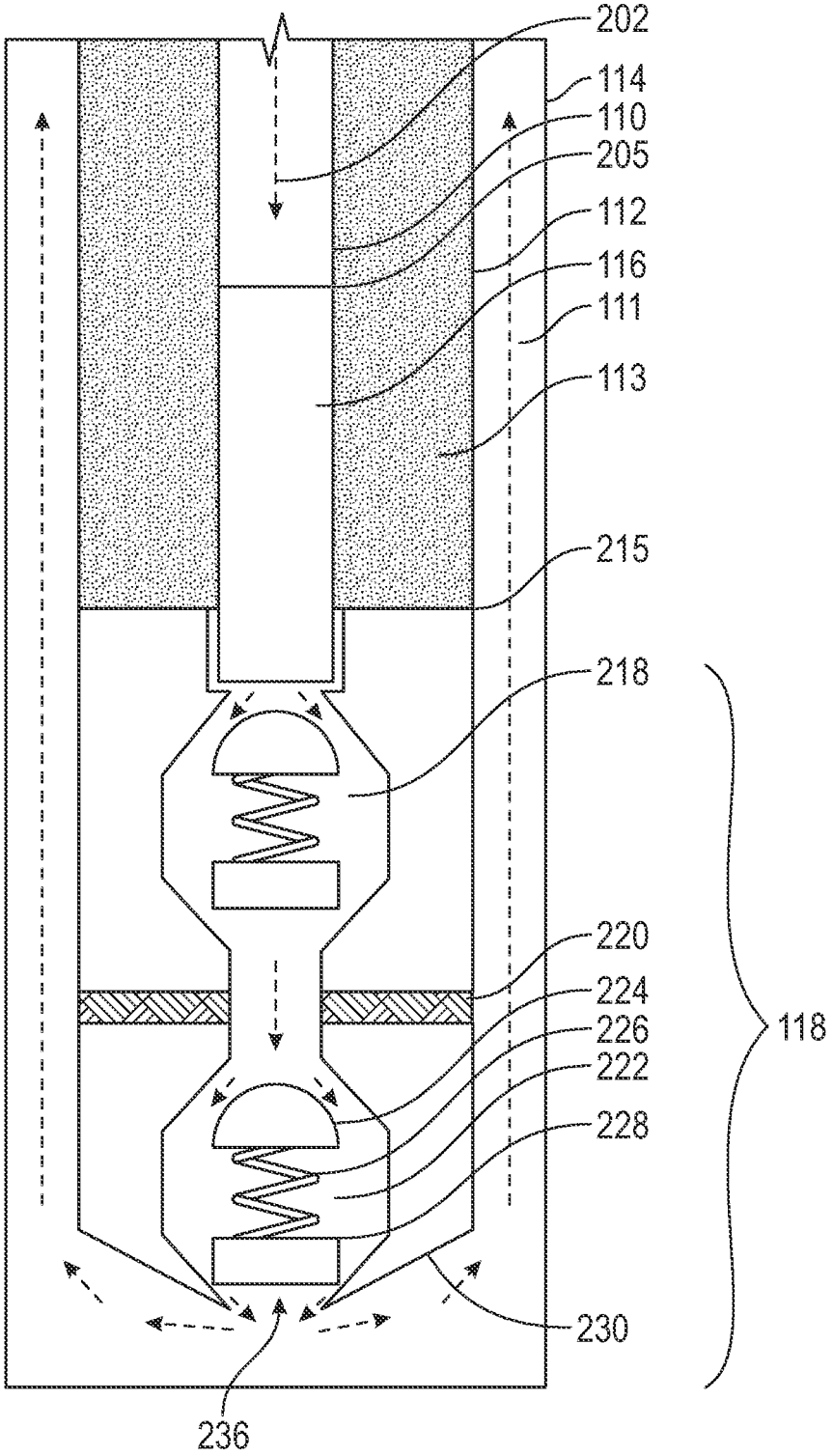
FIG. 3 shows an arrangement in which two check valves are provided, in accordance with one or more embodiments.

In accordance with one or more embodiments, FIG. 3 shows an arrangement in which two check valves are provided (218, 222). As shown, the drill string (110) is coupled to the stab-in stinger (116) and stabbed into the stab-in float shoe (118). The stab-in float shoe (118) has a first check valve (218), a second check valve (222) and two plug-type rupture discs (220) on the inside of the stab-in float shoe (118). The plug-type rupture discs (220) are housed in the stab-in float shoe (118), between the first check valve (218) and the second check valve (222). The first check valve (218) and the second check valve (222) are integral check valves that allow fluid to flow in one direction within the stab-in float shoe (118), the direction being from the terrestrial surface (120) to the casing-wellbore annulus (111). The first check valve (218) and the second check valve (222) prevent reverse flow of fluid or U-tubing of fluid from entering the inside of the drill string (110). The second check valve (222) is configured, and functions essentially similarly to the first check valve (218). Thus, the second check valve (222) has a valve member (224) connected to a valve seat (228) via a spring (226).

In accordance with one or more embodiments, once the stab-in stinger (116) is stabbed into the stab-in float shoe (118), the cement operation starts by pumping the cement mixture (202) into the drill string (110), through the stab-in stinger (116) and into the stab-in float shoe (118). The cement mixture (202) reaches the first check valve (218) and exerts pressure on the valve member (224) to compress the spring (226) and open a passage for the cement mixture (202). The plug-type rupture discs (220) are not ruptured, allowing the cementing mixture (202) to reach the second check valve (222). The cement mixture (202) reaches the second check valve (222) and exerts pressure on the valve member (224) to compress the spring (226) and open a passage for the cement mixture (202) into the casing-wellbore annulus (111).

In accordance with one or more variant embodiments, the stab-in float shoe (118) may include a first check valve (218) and a single plug-type rupture disc (220) on the inside of the stab-in float shoe (118). The plug-type rupture disc is housed in the stab-in float shoe (118), between the first check valve (218) and an outlet (236).

In accordance with one or more embodiments, the stab-in float shoe (118) may house an alternation of a plurality of check valves (218) and a plurality of pairs of plug-type rupture discs (220) connected in series. For instance, there may be three check valves (218) and two pairs of plug-type rupture discs (220), or four check valves (218) and three pairs of plug-type rupture discs (220), wherein the check valves (218) and pairs of plug-type rupture discs (220) alternate in series along an axial direction of the casing (112). In such embodiments, the pairs of plug-type rupture discs (220) may be set to rupture at different predetermined threshold pressures.

In accordance with one or more variant embodiments, the stab-in float shoe (118) may house an alternation of a plurality of check valves (218) and a plurality of single plug-type rupture discs (220) connected in series. For instance, there may be three check valves (218) and two plug-type rupture discs (220), or four check valves (218) and three plug-type rupture discs (220), wherein the check valves (218) and the plug-type rupture discs (220) alternate in series along an axial direction of the casing (112). In such embodiments, the plug-type rupture discs (220) may be set to rupture at different predetermined threshold pressures.

In accordance with one or more variant embodiments, the stab-in float shoe (118) may house an alternation of a plurality of check valves (218) and a plurality of a set of plug-type rupture discs (220) connected in series, wherein a set of plug-type rupture discs constitutes three or more rupture discs (220). For instance, there may be three check valves (218) and two sets of plug-type rupture discs (220), or four check valves (218) and three sets of plug-type rupture discs (220), wherein the check valves (218) and the set of plug-type rupture discs (220) alternate in series along an axial direction of the casing (112). In such embodiments, the different sets of plug-type rupture discs (220) may be set to rupture at different predetermined threshold pressures.

Figure 4:
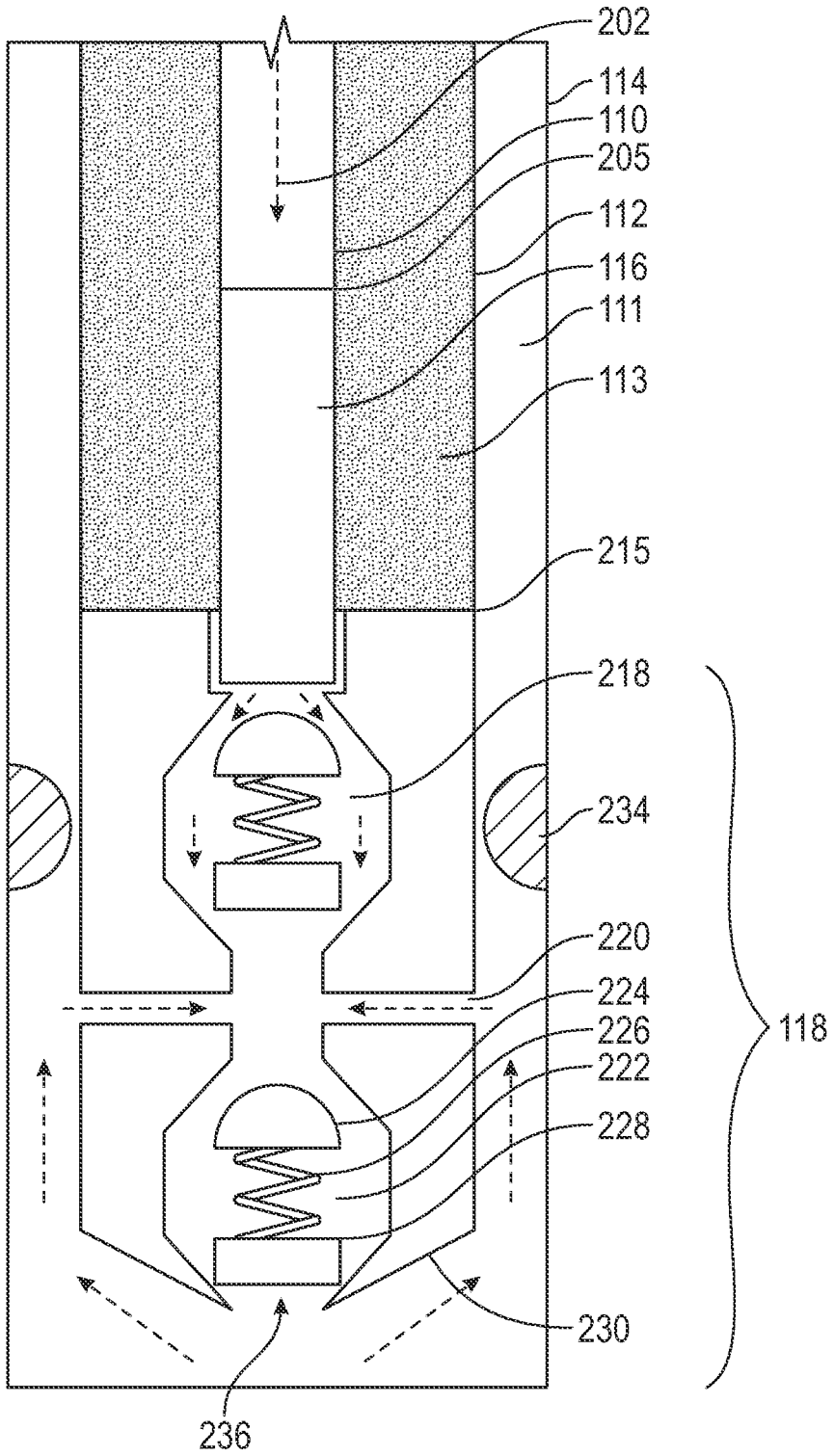
FIG. 4 provides essentially the same view as FIG. 3, but with the plug-type rupture discs ruptured, in accordance with one or more embodiments.

In accordance with one or more embodiments, FIG. 4 provides essentially the same view as FIG. 3, but with the plug-type rupture discs (220) ruptured. In this scenario, bridging (234) has occurred in the casing-wellbore annulus (111) as described heretofore, e.g., in view of a related buildup of material that inhibits the flow of cement mixture (202) uphole within the casing-wellbore annulus (111). Particularly, once bridging (234) occurs in the casing-wellbore annulus (111), the flow of the cement mixture (202) is obstructed, and the pressure in the casing-wellbore annulus (111) may increase. When the pressure in the casing-wellbore annulus (111) reaches the predetermined threshold pressure, the plug-type rupture discs (220) rupture and permit the flow of the cement mixture (202) radially inwardly into the stab-in float shoe (118), as shown via the horizontal arrows. The cement mixture (202) then exerts pressure on the drill string (110) in an uphole direction. The upward pressure in the stab-in float shoe (118) causes the first check valve to close. The first check valve (218) will then permit the cementing operation to resume, once the cause of the pressure increase (e.g., bridging) in the casing-wellbore annulus (111) is located and resolved.

In accordance with one or more embodiments, it should be understood and appreciated that the arrangement shown in FIG. 2, inclusive of only two check valves (218), will function similarly to the arrangement shown in FIGS. 3 and 4. The main difference generally resides in the manner of delivery of the cement mixture (202), wherein it would pass through only one check valve (218) instead of two. However, bridging in the casing-wellbore annulus (111) will lead to essentially the same effect as in FIGS. 3 and 4, where the plug-type rupture discs (220) indeed become ruptured and permit the flow of cement mixture (202) in a radially inward direction, to then exert pressure on the drill string (110) in an uphole direction.

Figure 5:
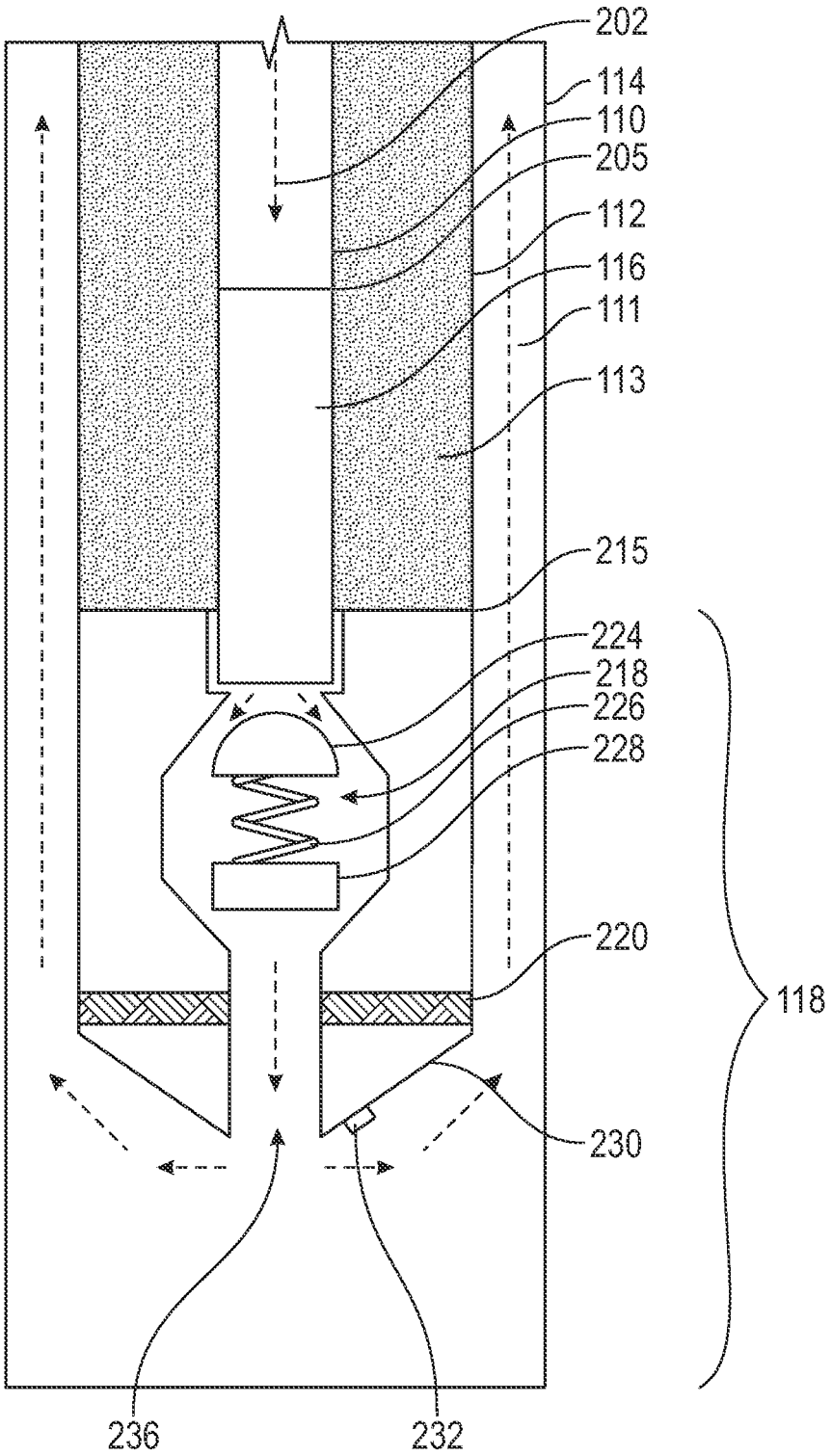
FIG. 5 provides essentially the same view as FIG. 2, but shows the addition of a pressure sensor, in accordance with one or more embodiments.

In accordance with one or more embodiments, FIG. 5 provides essentially the same view as FIG. 2 but shows the addition of a pressure sensor (232). Accordingly, the pressure sensor (232) is mounted on an outer surface of the nose (230) of the stab-in float shoe (118) and is configured to measure the pressure in the casing-wellbore annulus (111). Though only one such pressure sensor (232) is shown, it should be appreciated and understood that more than one may be provided.

Figure 9:
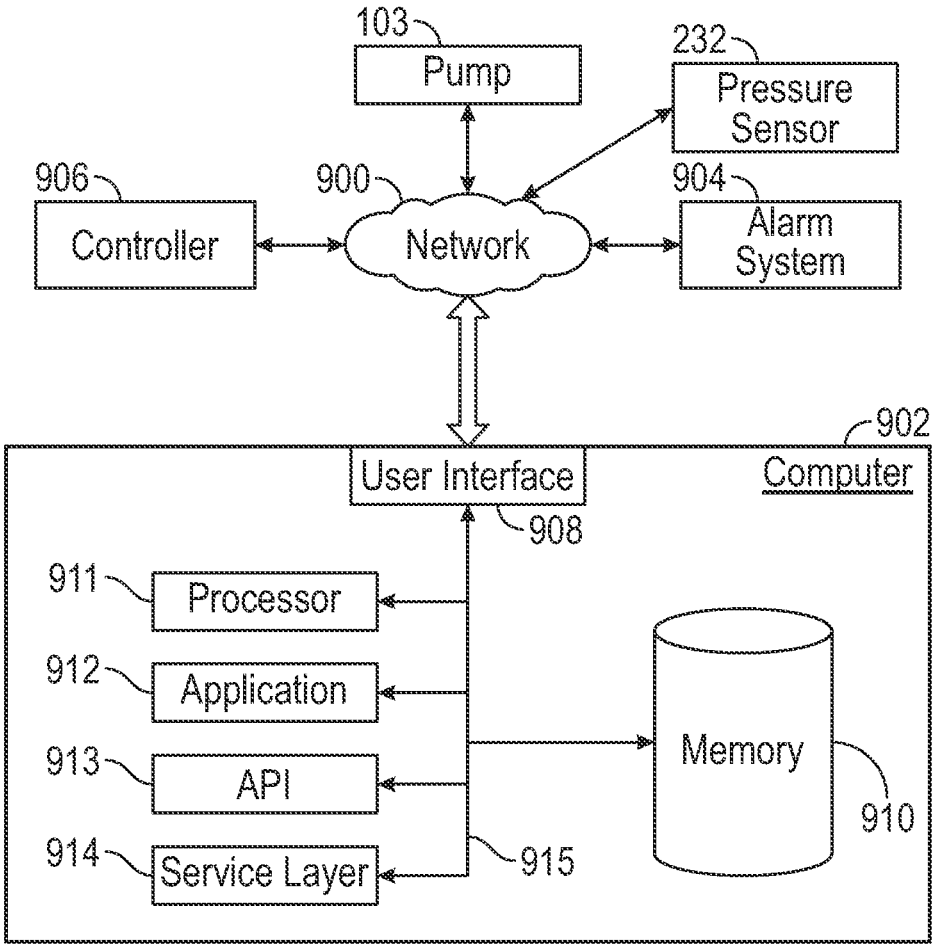
FIG. 9 schematically illustrates a computing device and related components, in accordance with one or more embodiments.

In accordance with one or more embodiments, the pressure sensor (232) may be in communication with a computer and/or alarm system (e.g., such as those indicated at 902 and 904, respectively, in FIG. 9) to alert a user about a pressure in the casing-wellbore annulus (111) reaching a predetermined threshold, and/or to initiate an automatic shutdown procedure for shutting down pump (102). Alternatively, a user may monitor a pressure increase in the casing-wellbore annulus (111) and initiate shutdown procedure before the rupturing of the plug-type rupture discs (220). For instance, for this purpose, the pressure sensor (232) may be in communication with a user interface (908) of a computer (902) as shown in FIG. 9. In either scenario, the pressure sensor (232) may serve as an additional safeguard to augment the function of plug-type rupture discs (220) as described heretofore, that is, to provide for alerting a user and/or shutting down pump (102) in addition to stopping the flow of cement mixture (202) via plug-type rupture discs (220) as previously discussed.

Figure 6:
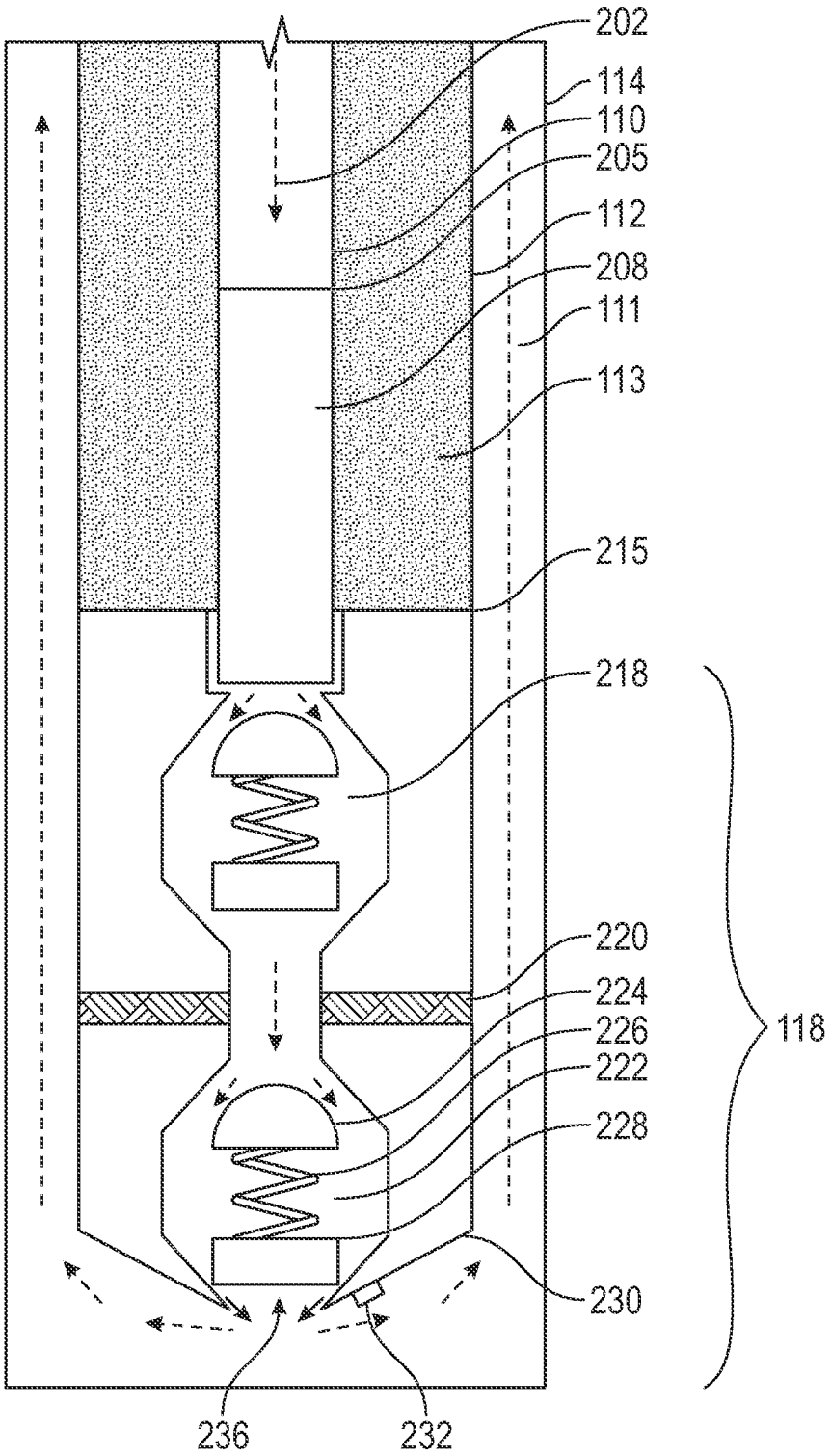
FIG. 6 provides essentially the same view as FIG. 3, with the provision of two check valves, but also shows the addition of a pressure sensor, in accordance with one or more embodiments.

In accordance with one or more embodiments, FIG. 6 provides essentially the same view as FIG. 3, with the provision of two check valves (218, 222), but also shows the addition of a pressure sensor (232) as in FIG. 5. Accordingly, the pressure sensor (232) may be configured, and may function, in similar fashion as discussed with respect to FIG. 5. Additionally, the two check valves (218, 222) and plug-type rupture discs (220) may be configured, and may function, in similar fashion as discussed with respect to FIG. 3.

Figure 7:
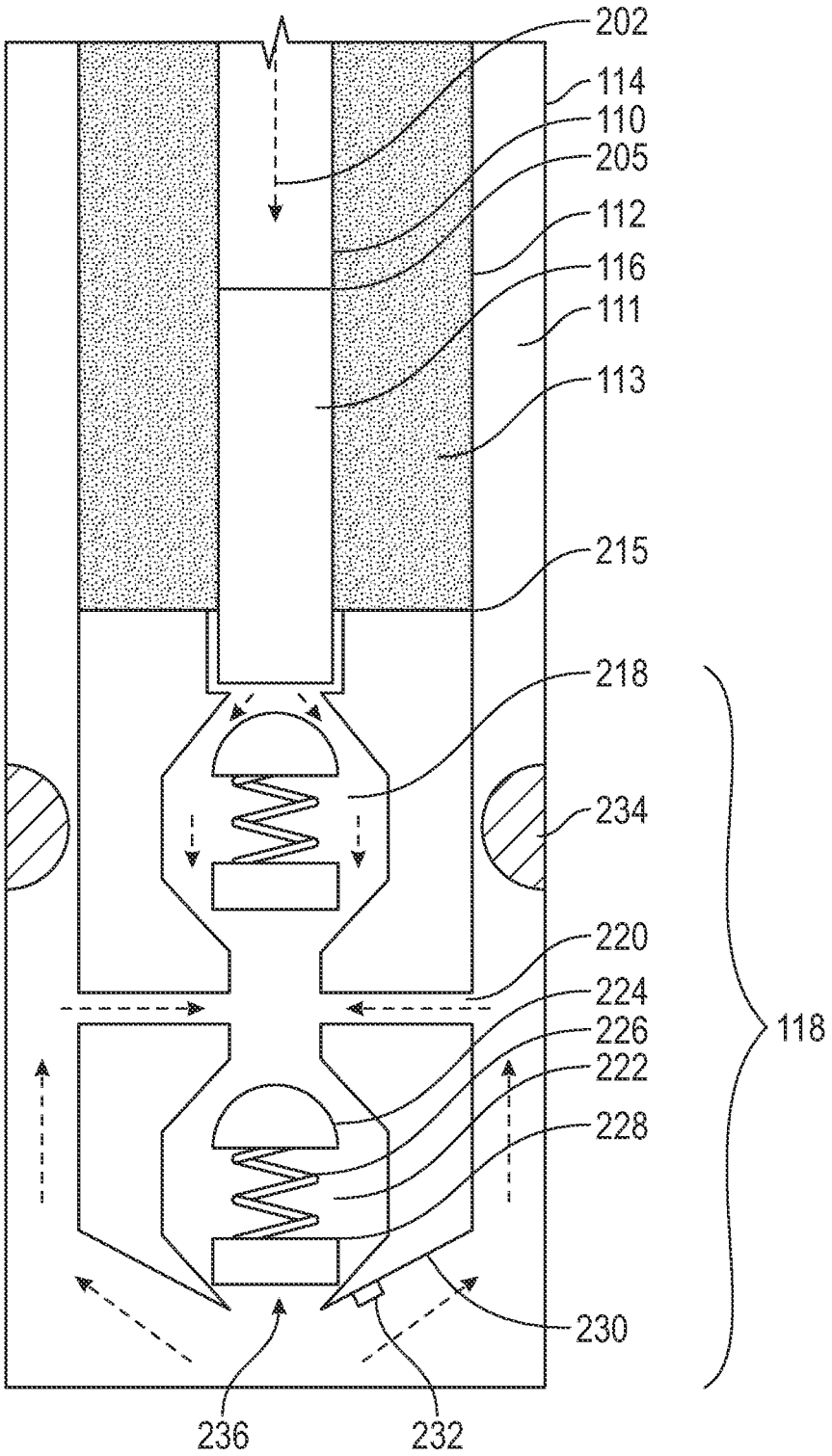
FIG. 7 provides essentially the same view as FIG. 6, but with the plug-type rupture discs ruptured, in accordance with one or more embodiments.

In accordance with one or more embodiments, FIG. 7 provides essentially the same view as FIG. 6, but with the plug-type rupture discs (220) ruptured. Thus, the function of check valves (218, 222) and plug-type rupture discs (220), and related effects brought by the presence of bridging (234), can be understood as similar to the related description for FIG. 4. In this case, as the cement mixture (202) exerts pressure on the drill string (110) in an uphole direction, such exerted pressure on the drill string (110) may be noticed on the weight indicator (107). As in the case of FIG. 4, the cementing operation may resume once the cause of the pressure increase (e.g. bridging) in the casing-wellbore annulus (111) is located and resolved.

Figure 8:
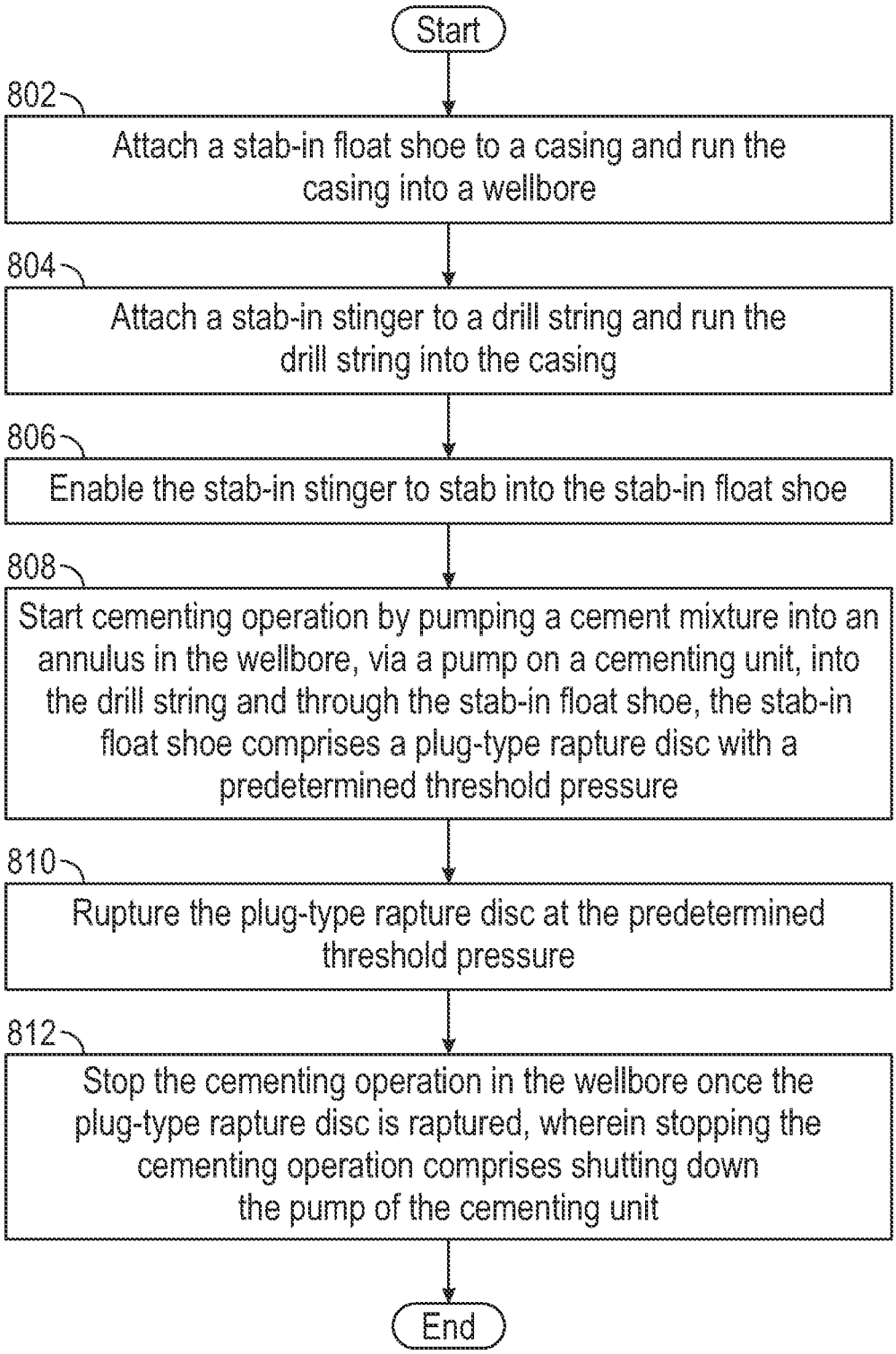
FIG. 8 shows a flowchart of a method in accordance with one or more embodiments.

In accordance with one or more embodiments, FIG. 8 depicts a flowchart in accordance with one or more embodiments. More specifically, FIG. 8 illustrates a method for cementing a casing-wellbore annulus (111) of a well. Further, one or more blocks in FIG. 8 may be performed by one or more components as described in FIGS. 1-7. While the various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Thus, in accordance with one or more embodiments, in step 802, a stab-in float shoe (118) may be attached to a casing (112) and ran into a wellbore (114). In step 804, a stab-in stinger (116) may be attached to a drill string (110) and ran into a casing (112). In step 806, a stab-in stinger (116) may be stabbed into the stab-in float shoe (118).

In accordance with one or more embodiments, in step 808, cementing operation may be started by pumping a cement mixture (202) into a casing-wellbore annulus (111) in a wellbore (114). The cementing mixture (202) may be pumped via a pump (102) on a cementing unit (100), into a drill string (110) and through the stab-in float shoe (118). The stab-in float shoe (118) may comprise a plug-type rupture disc (220) with a predetermined threshold pressure. Once the predetermined threshold pressure is reached in the casing-wellbore annulus (111), in step 810, a plug-type rupture disc (220) may rupture and may allow the flow of the cement mixture (202) back into the stab-in float shoe (118).

In accordance with one or more embodiments, in step 812, a cementing operation in a wellbore (114) may be stopped once a plug-type-rupture disc has ruptured, wherein a pump (102) on a cementing unit (100) may be shut down.

In accordance with one or more embodiments, FIG. 9 shows a computer (902) in communication with an alarm system (904), a pressure sensor (232), a pump (102) and a controller (906). The communication may occur over a network (900) that may be a local area network using an ethernet or Wi-Fi system, or alternatively the network (900) may be a wide area network using an internet or intranet service. Alternatively, the communication may be transmitted over a network (900) using satellite communication networks.

As such, in accordance with one or more embodiments, FIG. 9 further depicts a block diagram of a computer (902) used to provide computational functionalities associated with described algorithms, methods, functions, processes, flows, and procedures as described in this disclosure, according to one or more embodiments. The illustrated computer (902) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (902) may include a computer that includes an input device, such as a keypad, keyboard, touch screen, or other device that can accept user information, and an output device that conveys information associated with the operation of the computer (902), including digital data, visual, or audio information (or a combination of information), or a GUI.

The computer (902) can serve in a role as a client, network component, a server, a database or other persistency, or any other component (or a combination of roles) of a computer system for performing the subject matter described in the instant disclosure. The illustrated computer (902) is communicably coupled with a network (900). In some implementations, one or more components of the computer (902) may be configured to operate within environments, including cloud-computing-based, local, global, or other environment (or a combination of environments).

At a high level, the computer (902) is an electronic computing device operable to receive, transmit, process, store, or manage data and information associated with the described subject matter. According to some implementations, the computer (902) may also include or be communicably coupled with an application server, e-mail server, web server, caching server, streaming data server, business intelligence (BI) server, or other server (or a combination of servers).

The computer (902) can receive requests over network (900) from a client application (for example, executing on another computer (902) and responding to the received requests by processing the said requests in an appropriate software application. In addition, requests may also be sent to the computer (902) from internal users (for example, from a command console or by other appropriate access method), external or third-parties, other automated applications, as well as any other appropriate entities, individuals, systems, or computers.

Each of the components of the computer (902) can communicate using a system bus (915). In some implementations, any or all of the components of the computer (902), both hardware or software (or a combination of hardware and software), may interface with each other or the user interface (908) (or a combination of both) over the system bus (915) using an application programming interface (API) (913) or a service layer (914) (or a combination of the API (913) and service layer (914). The API (913) may include specifications for routines, data structures, and object classes. The API (913) may be either computer-language independent or dependent and refer to a complete interface, a single function, or even a set of APIs. The service layer (914) provides software services to the computer (902) or other components (whether or not illustrated) that are communicably coupled to the computer (902). The functionality of the computer (902) may be accessible for all service consumers using this service layer. Software services, such as those provided by the service layer (914), provide reusable, defined business functionalities through a defined interface. For example, the interface may be software written in JAVA, C++, or other suitable language providing data in extensible markup language (XML) format or another suitable format. While illustrated as an integrated component of the computer (902), alternative implementations may illustrate the API (913) or the service layer (914) as standalone components in relation to other components of the computer (902) or other components (whether or not illustrated) that are communicably coupled to the computer (902). Moreover, any or all parts of the API (913) or the service layer (914) may be implemented as child or submodules of another software module, enterprise application, or hardware module without departing from the scope of this disclosure.

The computer (902) includes a user interface (908). Although illustrated as a single user interface (908) in FIG. 9, two or more user interfaces (908) may be used according to particular needs, desires, or particular implementations of the computer (902). The user interface (908) is used by the computer (902) for communicating with other systems in a distributed environment that are connected to the network (900). Generally, the user interface (908 includes logic encoded in software or hardware (or a combination of software and hardware) and operable to communicate with the network (900). More specifically, the user interface (908) may include software supporting one or more communication protocols associated with communications such that the network (900) or interface's hardware is operable to communicate physical signals within and outside of the illustrated computer (902).

The computer (902) includes at least one computer processor (911). Although illustrated as a single computer processor (911) in FIG. 9, two or more processors may be used according to particular needs, desires, or particular implementations of the computer (902). Generally, the computer processor (911) executes instructions and manipulates data to perform the operations of the computer (902) and any algorithms, methods, functions, processes, flows, and procedures as described in the instant disclosure.

The computer (902) also includes a memory (910) that holds data for the computer (902) or other components (or a combination of both) that can be connected to the network (900). For example, memory (910) can be a database storing data consistent with this disclosure. Although illustrated as a single memory (910) in FIG. 9, two or more memories may be used according to particular needs, desires, or particular implementations of the computer (902) and the described functionality. While memory (910) is illustrated as an integral component of the computer (902), in alternative implementations, memory (910) can be external to the computer (902).

The application (912) is an algorithmic software engine providing functionality according to particular needs, desires, or particular implementations of the computer (902), particularly with respect to functionality described in this disclosure. For example, application (912) can serve as one or more components, modules, applications, etc. Further, although illustrated as a single application (912), the application (912) may be implemented as multiple applications (912) on the computer (902). In addition, although illustrated as integral to the computer (902), in alternative implementations, the application (912) can be external to the computer (902).

There may be any number of computers (902) associated with, or external to, a computer system containing computer (902), wherein each computer (902) communicates over network (900). Further, the term "client," "user," and other appropriate terminology may be used interchangeably as appropriate without departing from the scope of this disclosure. Moreover, this disclosure contemplates that many users may use one computer (902), or that one user may use multiple computers (902).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for performing a cementing operation in a wellbore, the system comprising:

a stab-in stinger connected to a distal end of a drill string, wherein the stab-in stinger is configured to stab into a stab-in float shoe; and a stab-in float shoe connected to a distal end of a casing that surrounds the drill string, wherein the stab-in float shoe is configured to permit flow a cement mixture into an annulus between the wellbore and the casing, the stab-in float shoe comprising:

a first check valve configured to prevent reverse flow of the cement mixture in the drill string, a plug-type rupture disc housed in the stab-in float shoe, between the first check valve and an outlet of the stab-in float shoe, wherein the plug-type rupture disc is configured to rupture at a predetermined threshold pressure and, once ruptured, permits flow of the cement mixture from the annulus into the stab-in float shoe, and a second check valve housed between the plug-type rupture disc and the outlet of the stab-in float shoe, wherein the second check valve is configured to prevent reverse flow of the cement mixture into the drill string.

2. The system of claim 1, wherein the first check valve and the second check valve each comprise a valve member mounted on a valve seat via a spring.

3. The system of claim 2 whereby, once the plug-type rupture disc is ruptured, the cement mixture exerts pressure on the drill string in an uphole direction.

4. The system of claim 3, wherein the casing is formed from steel and the predetermined threshold pressure of the plug-type rupture disc is less than a collapse pressure rating of the casing.

5. The system of claim 4, wherein the stab-in float shoe comprises an alternation of a plurality of check valves and a plurality of plug-type rupture discs.

6. The system of claim 5, further comprising a weight indicator attached to a dead line of the drill string.

7. The system of claim 6, further comprising:

a first pressure sensor mounted on a nose of the stab-in float shoe and configured to measure pressure in the annulus, a computer in communication with the first pressure sensor, wherein the computer is configured to monitor a pressure in the annulus, and a controller in communication with the computer and with a pump for the cement mixture, wherein the controller controls a pumping rate of the cement mixture into the drill string.

8. The system of claim 7, wherein a plurality of pressure sensors are mounted on the nose of the stab-in float shoe.

9. The system of claim 8, wherein the second pressure sensor is mounted on the casing.

10. The system of claim 9 further comprising:

a user interface in communication with the computer; and an alarm system in communication with the user interface, wherein the alarm system is configured to transmit an alert to the user interface before the predetermined threshold pressure of the plug-type rupture disc is reached and to send a signal to the controller to stop pumping of the cement mixture into the drill string.

11. A method for performing a cementing operation in a wellbore, the method comprising:

attaching a stab-in float shoe to a casing and running the casing into the wellbore;

attaching a stab-in stinger to a drill string and running the drill string into the casing;

enabling the stab-in stinger to stab into the stab-in float shoe;

starting the cementing operation by pumping a cement mixture into an annulus in the wellbore, via a pump on a cementing unit, into the drill string through the stab-in float shoe;

wherein the stab-in float shoe comprises a plug-type rupture disc;

rupturing the plug-type rupture disc at a predetermined threshold pressure in the annulus;

stopping the cementing operation in the wellbore once the plug-type rupture disc ruptures, wherein stopping the cementing operation comprises shutting down the pump of the cementing unit.

12. The method of claim 11, wherein the stab-in stinger is screwed into the stab-in float shoe.

13. The method of claim 12, further comprising:

obtaining a drill string weight from a weight indicator.

14. The method of claim 13 wherein, once ruptured, the plug-type rupture disc stops a flow of the cement mixture through the stab-in float shoe and exerts pressure on the drill string in an uphole direction.

15. The method of claim 14, further comprising:

mounting a first pressure sensor on a nose of the stab-in float shoe; and measuring a pressure in the annulus via the first pressure sensor;

based on the measured pressure:

activating an alarm before the predetermined threshold pressure is reached; and adjusting a pump rate of the pump.

* * * * *